US006503051B2

(12) United States Patent
Predmore

(10) Patent No.: US 6,503,051 B2
(45) Date of Patent: Jan. 7, 2003

(54) OVERLAPPING INTERFERENCE SEAL AND METHODS FOR FORMING THE SEAL

(75) Inventor: Daniel Ross Predmore, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/874,375

(22) Filed: Jun. 6, 2001

(65) Prior Publication Data

US 2002/0187040 A1 Dec. 12, 2002

(51) Int. Cl.[7] ..... F01D 25/26
(52) U.S. Cl. ..... 415/135; 415/191; 277/312
(58) Field of Search ..... 415/135, 139, 415/191; 277/312, 27

(56) References Cited

U.S. PATENT DOCUMENTS 3,623,736 A * 11/1971 Petrie et al. ..... 277/27
4,114,368 A * 9/1978 Davis et al. ..... 60/39.16 R
4,121,860 A * 10/1978 Hoffman ..... 285/226
4,537,024 A * 8/1985 Grosjean ..... 60/39.161
4,767,267 A * 8/1988 Salt et al. ..... 415/174
5,127,793 A * 7/1992 Walker et al. ..... 415/115
5,188,507 A * 2/1993 Sweeney ..... 415/173.1
5,197,281 A * 3/1993 Przytulski et al. ..... 60/226.1
5,797,723 A * 8/1998 Frost et al ..... 415/174.2
6,164,656 A * 12/2000 Frost ..... 277/312

* cited by examiner

*Primary Examiner*—Edward K. Look
*Assistant Examiner*—James M McAleenan
(74) *Attorney, Agent, or Firm*—Nixon & Vanderhye

(57) ABSTRACT

A seal is provided between a pair of members by a flexible seal element fixed to one member and having a turned edge. The seal element overlies a contact surface of the other member to effect the seal, the seal element spanning a gap between the members and being pressed into the contact surface by a high pressure region on the same side of the gap as the sealing element. In other forms, a second sealing element is employed in conjunction with a spline seal forming a tortuous sealing path between the members.

20 Claims, 2 Drawing Sheets

OVERLAPPING INTERFERENCE SEAL AND METHODS FOR FORMING THE SEAL

BACKGROUND OF THE INVENTION

This invention was made with Government support under Contract No. DE-FC21-95MC31176 awarded by the Department of Energy. The Government has certain rights in this invention.

The present invention relates to seals for sealing adjacent components in a gas turbine and particularly relates to an overlapping interference seal for minimizing fluid flow through a gap between adjacent components and methods of assembly.

Many and various types of seals have been applied between adjacent components to seal the components to one another or to minimize the flow between opposite sides of the seal. For example, spline seals are employed to prevent or minimize leakage through the gap between adjacent shroud segments of a gas turbine. It will be appreciated that a plurality of such shroud segments are arranged in an annular array thereof about the rotor axis of a gas turbine. Both of the inner and outer side walls of the shrouds form a gap between high and low pressure regions which either must be sealed or at least leakage flow minimized. Such spline seal systems utilize long narrow flat seals loosely assembled in opposing slots of two adjacent side walls of the shrouds. The pressure differential forces the spline seal against a sealing surface along each of the shroud slots. The slots and spline seal serve to create two labyrinth paths, impeding leakage flow through the gap. While such spline seals have been satisfactory, they are characterized by high temperatures, variable pressure gradients and excessive life requirements. Thus, there is a need for a seal between components in a gas turbine having improved sealing characteristics.

BRIEF SUMMARY OF THE INVENTION

In accordance with a preferred embodiment of the present invention, there is provided an overlapping interference seal for sealing a gap between a pair of adjacent gas turbine components. The seal is rugged and robust and can tolerate finite amounts of relative motion, misalignment and manufacturing tolerances. To accomplish the foregoing, and in a first embodiment hereof, there is provided a pair of gas turbine components, for example, shrouds, disposed in side-by-side relation one with the other with a gap therebetween. The components generally have planar surfaces along the edges of the components adjacent the gap. A seal element is disposed between the components and has seal surfaces engaging the planar surfaces of the components. The seal element is secured to one of the components and overlies a planar sealing surface along the opposite component, enabling relative sliding movement therebetween. Because the seal element is formed of a thin material, the high pressure on one side of the seal element forces the element into contact and sealing engagement along the planar surface of the other component to effect the seal. In this embodiment, the seal element includes an upturned elongated leading edge. With the proximal edge of the seal secured to one of the components, the assembly of the seal is facilitated by displacing the components toward one another. In this manner, the leading upturned edge of the seal element engages along the opposing surface of the component, enabling a smooth engagement of the sealing element with the planar surface. The sealing element may be employed separately from or in combination with a spline seal. The spline seal may be disposed in slots along the adjoining edges of the components, with the sealing element overlying the spline seal.

In another form of the present invention, a pair of sealing elements are provided. One sealing element is fixed to one of the components and has an elongated leading edge, while the other sealing element is fixed to the other component. A recess is formed in the components for receiving a spline seal. The recess may directly underlie the sealing elements or comprise registering slots along opposing side edges of the components to receive the spline seal. One of the edges of the recesses is preferably chamfered to facilitate assembly of the seal, as described below. In final assembly, the one sealing element overlies the other sealing element, forming a seal between their contacting surfaces. The underlying sealing element may also overlie and contact a portion of the spline seal between the components. Alternatively, the spline seal may be spaced from the sealing elements and have chamfered surfaces along opposite edges thereof to facilitate assembly of the seal.

The present invention also embraces a method of forming the seal. For example, the adjacent components are placed in lateral registration with one another. As the components are relatively advanced toward one another, the leading edge of the sealing element facilitates initial engagement between the sealing element and the other component. Continued displacement causes the sealing surface to engage along the planar surface. Where two sealing elements are employed, the spline seal is first inserted into the recess, e.g., slot. In one form, the spline seal is inserted between a component and one of the sealing elements and is releasably retained, e.g., clamped between the component and element. Consequently, with a chamfer on the other component and a leading edge on the other sealing element, the components may be displaced toward one another with the sealing element and spline engaging between the first sealing element and the component with the chamfer. Alternatively, the spline seals may have chamfers along opposite edges to facilitate their insertion into the recess, e.g., slots, upon relative displacement of the components toward one another.

In a preferred embodiment according to the present invention, there is provided in a gas turbine, a seal between high and low pressure regions, comprising a pair of members spaced from one another and movable toward and away from one another, each member having a generally planar surface, a seal element between the members and having sealing surfaces engaging the planar surfaces, respectively, the seal element being secured to one of the members, one of the sealing surfaces of the seal element being in slidable engagement with the planar surface of another of the members and the seal element having a leading edge overlying another member and extending away from another member.

In a further preferred embodiment according to the present invention, there is provided in a gas turbine, a seal between high and low pressure regions, comprising first and second members spaced from one another and movable toward and away from one another, each member having a generally planar surface, first and second seal elements carried by the first and second members, respectively, the seal elements having respective sealing surfaces in slidable engagement with one another, one of the seal elements having a leading edge overlying another of the sealing elements and extending away from another sealing element, each member having an elongated recess in opposition to an elongated recess along an opposing member, an elongated spline seal engaged in the recesses and having sealing surfaces therealong engaging seal faces along the recesses of the members, the spline seal extending between the members and lying on one side of the seal element.

In a further preferred embodiment according to the present invention, there is provided in a gas turbine having first and second members spaced from one another and movable toward and away from one another, a seal including at least one sealing element between the members, the sealing element being fixed to the first member and extending therefrom to overlie a planar sealing surface along the second member, a method of assembling the seal, comprising the steps of forming a leading edge on one sealing element along a distal edge thereof extending to one side of a plane containing the sealing element and displacing at least one of the members toward another member such that the leading edge guides the one sealing element along the second member to engage a sealing surface carried by the one sealing element along an opposite side of the plane containing the sealing element against the planar sealing surface of the second member to form a seal between the members.

In a further preferred embodiment according to the present invention, there is provided in a gas turbine having first and second members spaced from one another and movable toward and away from one another, a seal between the members including first and second sealing elements carried by the first and second members, respectively, a method of assembling the seal comprising the steps of forming a leading edge on the first sealing element along a distal edge thereof extending to one side of a plane containing the first sealing element and displacing at least one of the members toward another of the members such that the leading edge guides the first sealing element along the second sealing element to engage a sealing surface carried by the first sealing element along an opposite side of the plane against a sealing surface carried by the second sealing element.

DETAILED DESCRIPTION OF THE INVENTION

Figure 1:
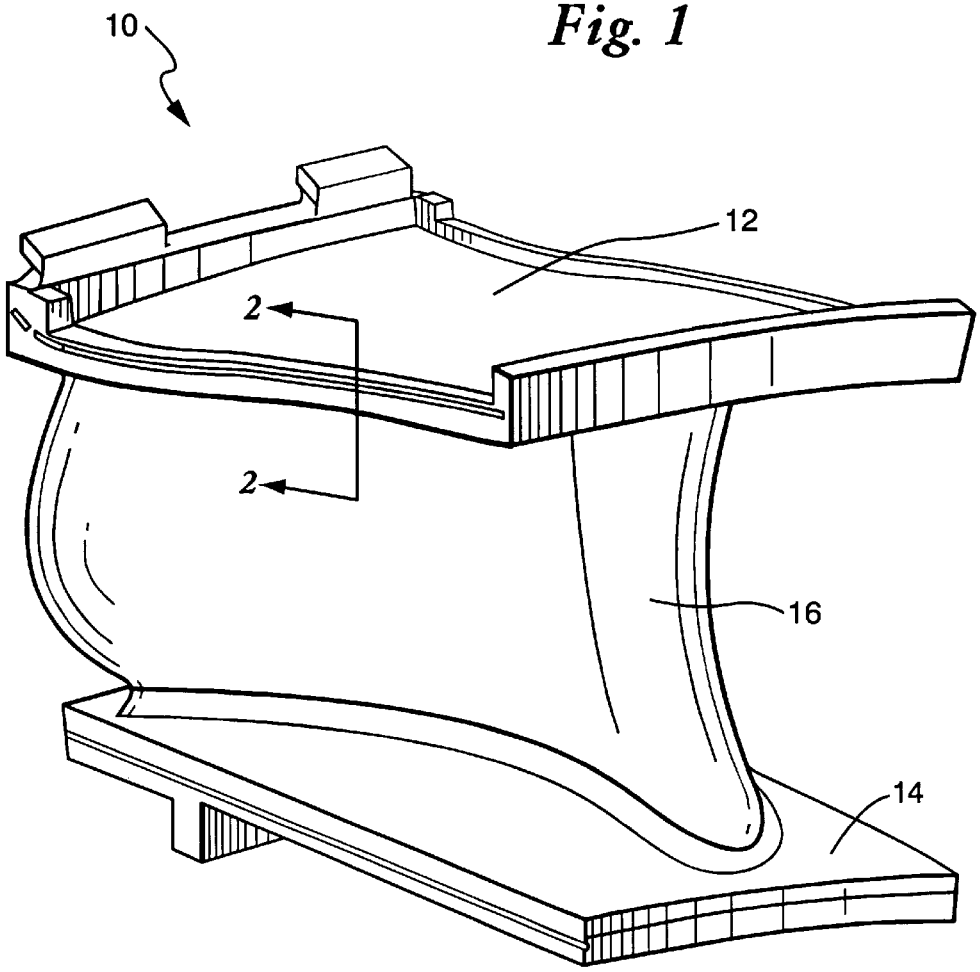
FIG. 1 is a perspective view of a nozzle stage segment for a stage of a gas turbine in which intersegment seals are employed.

Referring to the drawings, particularly to FIG. 1, there is illustrated a nozzle stage segment, generally designated 10, forming part of an annular array of segments about the rotational axis of a gas turbine, not shown. Each nozzle segment 10 comprises an outer band portion 12, an inner band portion 14 and one or more vanes 16 extending between the outer and inner band portions 12 and 14, respectively. In the annular array of nozzle segments, it will be appreciated that the side walls or edges of the outer and inner band portions lie directly adjacent side walls or edges of adjacent nozzle segments whereby the vanes 16 and the outer and inner bands form a complete annular array of nozzle segments about the rotor axis.

Figure 2:
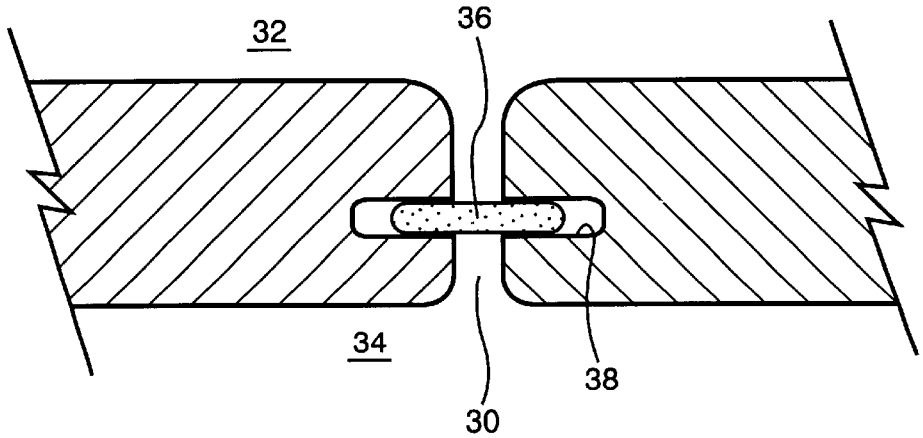
Fig. 2 (Prior Art)
FIG. 2 is an enlarged fragmentary cross-sectional view of a conventional spline seal between adjacent segments.

As finally assembled, the nozzle segments are arranged in an annular array thereof, with a gap 30 between the adjacent segments. As illustrated in FIG. 2, spline seals 36 are typically provided to reduce the flow leakage between high and low pressure regions on opposite sides of the outer band portions, represented, respectively, by high pressure region 32 and low pressure region 34. A spline seal 36 is disposed in slots 38 along adjacent side walls of the nozzle segments for reducing the flow leakage across the seal and through the gap. It will be appreciated that the foregoing description of a seal between adjacent nozzle segments of a gas turbine is exemplary of a seal for preventing leakage between any pair of components of a gas turbine in which a seal is provided for sealing between high and low pressure regions on opposite sides of the seal. Therefore, the foregoing and following references to seals between adjacent nozzle segments are considered exemplary.

Figure 3:
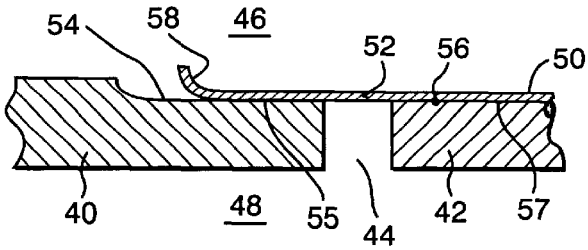
FIGS. 3–7 are respective fragmentary cross-sectional views of various overlapping interference-type seals between components in accordance with embodiments of the present invention.

Referring now to FIG. 3, there is illustrated a pair of members 40, 42 spaced one from the other and defining a gap 44 therebetween. The members 40, 42 may comprise any two components of a gas turbine, e.g., the outer shroud portions, which have a gap therebetween and which components are movable toward and away from one another during turbine operation. Typically, the members 40, 42 lie on opposite sides of high and low pressure regions 46 and 48, respectively, and require sealing between the components and across the gap. To accomplish this, a flexible seal element 50, preferably formed of metal, extends between the components 40, 42 and seals gap 44. Seal element 50 is secured to one of the members 42, for example, by welding, and includes a cantilevered portion 52 which extends beyond the edge of member 42 and beyond the width of the gap. The members 40, 42 are preferably recessed along their opposite surfaces, for example, at 54 and 56, to receive the overlying seal element 50. The seal element 50 includes a leading edge 58 turned in a direction away from the underlying member 40. Preferably, the turned edge 58 forms a radius. The surfaces of the recesses 54 and 56 form planar contact surfaces against respective sealing surfaces 55 and 57 of the seal element 56 bear for sealing the gap 44 between the two members 40 and 42.

It will be appreciated that the seal illustrated in FIG. 3 may be readily assembled. For example, in the event the seal is used to seal outer band portions of the shrouds to one another, the member 42, to which the seal element 50 is fixed, may be displaced toward the member 40. The leading edge 58 engages the member 40 and ensures that the seal element 50, when displaced toward member 40, engages the contact sealing surface 54 of the recess. Consequently, the seal illustrated in FIG. 3 affords easy assembly, as well as an effective seal, enabling the high pressure on one side of the seal to flex or deform the seal element 50 into sealing engagement with the members 40 and 42.

Figure 4:
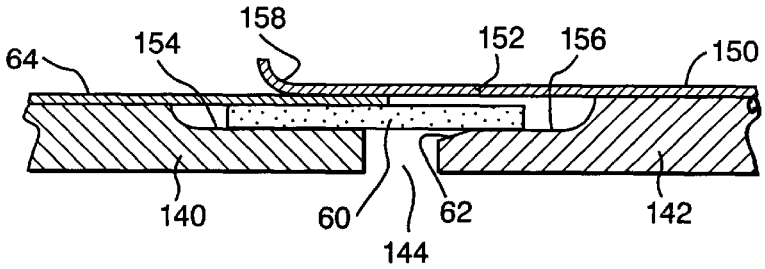

Referring to FIG. 4, wherein like parts are designated by like reference numerals, preceded by the prefix 1, the recesses 154 and 156 carry a spline seal 60. The spline seal is an elongated flat strip 60, preferably formed of metal, which seats on the sealing surfaces of the recesses 154 and 156. For reasons discussed below, member 142 includes a chamfer 62 along a leading edge thereof. As in the previous embodiment, a seal element 150 extends from and is fixed to member 142, element 150 being cantilevered at 152 to extend across the gap 144 between the members 140 and 142. Instead of directly engaging member 140, seal element 150 engages another seal element 64 fixed on member 140. Seal element 64 projects from and overlies recess 154. Both seal elements 150 and 64 are formed of thin, flexible sheet, preferably metal, materials.

It will be appreciated that the seal thus formed has multiple sealing surfaces, i.e., between the spline 60 and the contact surfaces of the members 140, 142, respectively; between spline 60 and seal element 64; and between the seal elements 64 and 150. Moreover, the seal illustrated in FIG. 4 is easily assembled. By disposing the spline seal 60 in the recess 154 formed by member 140 and overlying seal element 64, the spline seal 60 is captured in the position illustrated in FIG. 4 prior to assembly. By relatively displacing the members 140 and 142 toward one another, the chamfer 62 enables the spline seal 60 to ride over the edge of member 142 onto the planar contact surface 156 of member 142. Similarly, the turned leading edge 158 of seal element 150 facilitates engagement of seal element 150 over seal element 64.

Figure 5:
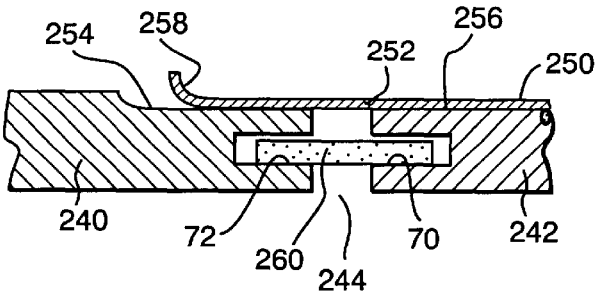

Referring now to FIG. 5, wherein like reference numerals are applied to like parts preceded by the prefix 2, the seal element 250 seals with the contact surfaces in recesses 254 and 256, sealing the members 240 and 242 to one another across the gap 244 spanned by cantilevered portion 252. In addition, a spline seal 260 is disposed in registering slots 70 and 72 formed along the edges of members 240, 242. The slots 70 and 72 open through the edge faces and register one with the other. Consequently, a tortuous sealing path is provided, first by the engagement of the seal element 252 along the contact surfaces of the recesses 254 and 256 and, secondly, by the contact between the edges of the spline 260 and the slot faces of the members 240 and 242. by the engagement of the seal element 252 along the contact surfaces of the recesses 254 and 256. Additionally, the embodiment of FIG. 5 is readily assembled. By locating the spline seal 260 in the slot 72 and relatively displacing the members 240, 242 toward one another, the spline seal is captured in the slots 70 and 72. Additionally, the leading edge 258 of the seal element 250 facilitates engagement of the seal surface of seal element 250 along the contact surface of the recess 254.

Figure 6:
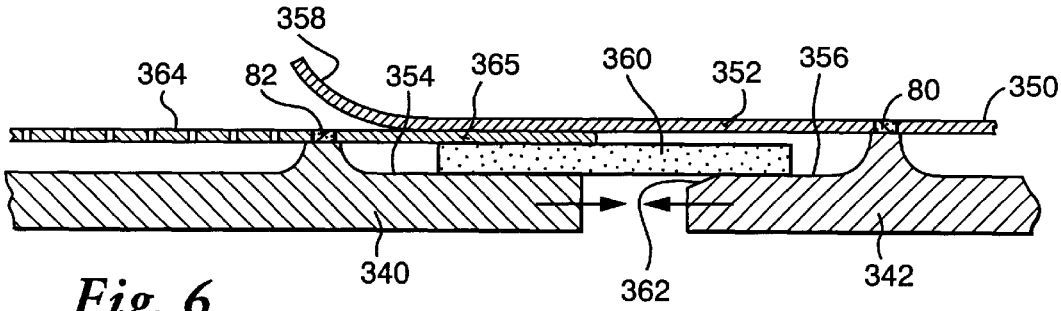

Referring now to the embodiment hereof illustrated in FIG. 6, wherein like reference numerals are applied to like parts, preceded by the prefix 3, the members 340 and 342 are provided with recesses 354 and 356 forming sealing contact surfaces. A spline seal 360 is disposed along the contact surfaces. The seal element 350 is fixed to the member 342, for example, by a weld 80, while the seal element 364 is similarly fixed to the member 340 by a weld 82. The seal element 364, however, forms a continuation of the perforated impingement plate, such as plate 22 illustrated in FIG. 2. The perforated plate 364 extends over the contact surface 354 of the member 340, as well as an edge portion of the spline seal 360. Note also the chamfer 362 formed along the edge of member 342.

It will be appreciated that a tortuous seal is similarly formed in the embodiment hereof illustrated in FIG. 6 between the spline seal 360 and the contact surfaces of the recesses 354 and 356; the spline seal 360 and the seal element 364; and the engagement of the seal element 364 and the cantilevered portion 352 of seal element 350 one with the other. Additionally, the seal of FIG. 6 is easily assembled. With the spline seal 360 captured in the recess 354 between member 340 and seal element 364, the members 340, 342 may be relatively displaced toward one another, as indicated by the arrows. The chamfer 362 facilitates the sliding engagement of the edge of spline seal 360 along the contact surface of member 342. Similarly, the leading or turned edge 358 of seal element 350 facilitates engagement of seal element 352 over seal element 364.

Figure 7:
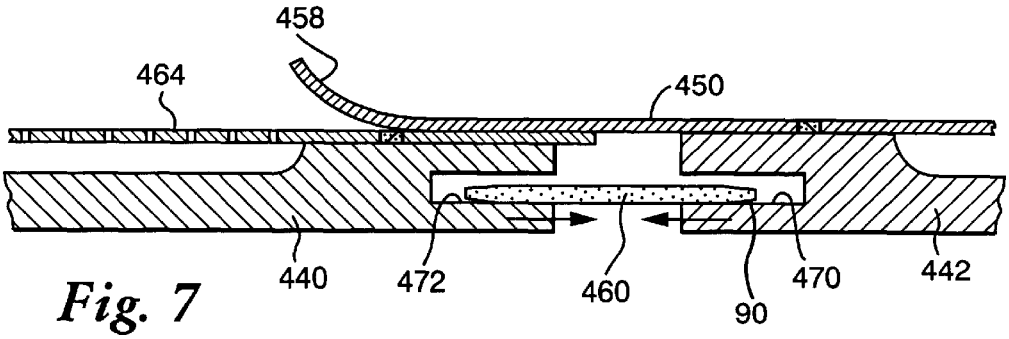

Referring now to the final embodiment hereof, illustrated in FIG. 7, wherein like parts have like reference numerals, preceded by the prefix 4, the edges of the members 440 and 442 have recesses or slots 470 and 472 which receive the margins of a spline seal 460. In this form, however, the spline seal has chamfers 90 formed along its opposite edges to facilitate assembly. The seal elements 450 and 464 engage one another along sealing surfaces. The seal thus has a tortuous sealing passage which minimizes leakage, the sealing surfaces including the engagement of the spline seal 460 along the contact surfaces of slots 470, 472, and the engagement of the seal elements 450 and 464 with one another. As in the preceding embodiments, the seal of FIG. 7 is readily assembled by disposing the spline seal 460 in one slot 472 and relatively displacing the members 440, 442 toward one another. The turned edge 458 on seal element 450 facilitates the engagement of seal element 450 along the sealing surface of seal element 464.

In all of these embodiments, it will be appreciated that the flexibility of the seal elements and their location along the high pressure side of the seal enables the seal elements to press firmly in sealing contact against the underlying contact surfaces, whether it is the corresponding sealing element or a contact surface of a member. Additionally, the arrangement facilitates assembly of the seals.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine, a seal between high and low pressure regions, comprising:

a pair of members spaced from one another and movable toward and away from one another and movable toward and away from one another, said members having generally planar surfaces extending generally in a common plane;

a seal element between said member and having sealing surfaces engaging said planar surfaces respectively;

said seal element being secured to one of said members, one of said sealing surfaces of said seal element being planar and in slidable engagement with the planar surface of another of said members; and said seal element having a leading edge overlying said another member and extending away from said common plane and away from said another member.

2. A seal according to claim 1 wherein said seal element is formed of a thin, flexible material such that differential pressure between the high and low pressure regions biases the sealing element into sealing engagement with the sealing surface of said another member.

3. In a gas turbine, a seal between high and low pressure regions, comprising:

a pair of members spaced from one another and movable toward and away from one another and movable toward and away from one another, each said member having a generally planar surface;

a seal element between said members and having sealing surfaces engaging said planar surfaces respectively;

said seal element being secured to one of said members, one of said sealing surfaces of said seal element being in slidable engagement with the planar surface of another of said members; and said seal element having a leading edge overlying said another member and extending away from said another member, each of said members having an elongated slot along an edge thereof in opposition to the slot along an edge thereof in opposition to the slot along an edge of an opposing member, an elongated spline seal engaged in said slots and having sealing surfaces therealong and in said slots engaging seal faces along the slots of said members, said spline seal extending between said members and lying on one side of said seal element.

4. In a gas turbine, a seal between high and low pressure regions, comprising:

first and second members spaced from one another and movable toward and away from one another, each said member having a generally planar surface;

first and second seal elements carried by said first and second members, respectively, said seal elements having respective sealing surfaces in slidable engagement with one another, one of said seal elements having a leading edge overlying another of said sealing elements and extending away from said another sealing element, each said member having an elongated recess in opposition to an elongated recess along an opposing member, an elongated spline seal engaged in said recesses and having sealing surfaces therealong engaging seal faces along the recesses of said members, said spline seal extending between said members and lying on one side of said seal element.

5. A seal according to claim 4 wherein said spline seal is spaced from said seal elements.

6. A seal according to claim 4 wherein one of said recesses has a chamfer along an edge thereof.

7. A seal according to claim 4 wherein said spline seal engages one of said elements.

8. A seal according to claim 4 wherein said recesses comprise slots formed in opposing edges of said members, said spline seal disposed in said slots with said sealing surfaces engaging said seal faces.

9. A seal according to claim 8 wherein said spline seal is spaced from said seal element.

10. A seal according to claim 4 wherein opposite elongated edges of said spline seal are chamfered along sides thereof for engaging edges of said members.

11. A seal according to claim 4 wherein said members include a pair of adjacent nozzle segments for defining in part a hot gas path through the turbine.

12. A seal according to claim 11 wherein each of said segments includes a wall defining the hot gas path and an impingement plate having apertures therethrough for flowing a cooling medium toward said walls, said another seal element comprising a continuation of one of said impingement plates.

13. In a gas turbine having first and second members spaced from one another and movable toward and away from one another, a seal including at least one generally planar seal element between said members, said seal element being fixed to said first member and having a planar portion thereof extending to overlie a planar sealing surface along said second member, a method of assembling the seal, comprising the steps of:

forming a leading edge on said planar portion of said one seal element along a distal edge thereof and extending to one side of a plane containing said sealing element; and displacing at least one of said members toward another member such that the leading edge guides said one sealing element along said second member to engage a sealing surface carried by said planar portion of said one sealing element along an opposite side of the plane containing said sealing element against said planar sealing surface of said second member to form a seal between the members.

14. A method according to claim 13 including providing slots along edges of said members in opposition to one another and inserting a spline seal into said slots forming a second seal between said members.

15. In a gas turbine having first and second members spaced from one another and movable toward and away from one another, a seal between said members including first and second seal elements carried by said first and second members, respectively, a method of assembling the seal comprising the steps of:

forming a leading edge on said first seal element along a distal edge thereof extending to one side of a plane containing said first seal element; and displacing at least one of said members toward another of said members such that the leading edge guides said first sealing element along said second sealing element to engage a sealing surface carried by said first sealing element along an opposite side of said plane against a sealing surface carried by said second sealing element.

16. A method according to claim 15 wherein said seal includes a spline seal, and inserting said spline seal between said members sealing a gap therebetween with said spline seal engaging said second sealing element.

17. A method according to claim 16 including forming a chamfer on said first member, capturing said spline seal between said second sealing element and said second member and engaging said spline seal along said chamfer as said one member is displaced toward said another member to facilitate disposition of said spline seal between said first sealing element and said first member.

18. A method according to claim 15 wherein said seal includes a spline seal, forming slots along edges of said members in opposition to one another and inserting the spline seal into said slots forming a second seal between said members with said spline seal spaced from said first and second sealing elements.

19. A method according to claim 18 including forming a chamfer on said first member, capturing said spline seal between said second sealing element and said second member and engaging said spline seal along said chamfer as said one member is displaced toward said another member to facilitate disposition of said spline seal between said first sealing element and said first member.

20. A method according to claim 18 including forming chamfers along opposite edges of said spline seal for engagement by said members as said one member is displaced toward said another member to facilitate insertion of said spline seal in said slots.

* * * * *